United States Patent [19]

Ikenoue et al.

[11] 4,267,267

[45] May 12, 1981

[54] THERMALLY-DEVELOPABLE LIGHT-SENSITIVE ELEMENTS

[75] Inventors: Shinpei Ikenoue; Takao Masuda, both of Minami-Ashigara, Japan

[73] Assignee: Fuji Photo Film Co., Ltd., Minami-ashigara, Japan

[21] Appl. No.: 81,237

[22] Filed: Oct. 2, 1979

Related U.S. Application Data

[63] Continuation-in-part of Ser. No. 868,167, Jan. 9, 1978, abandoned.

[30] Foreign Application Priority Data

Jan. 2, 1977 [JP] Japan ..... 52/2051

[51] Int. Cl.[3] ..... G03C 1/02

[52] U.S. Cl. ..... 430/533; 430/618; 430/619; 430/620; 430/531; 430/538; 430/567; 430/523; 430/961; 430/534; 430/535

[58] Field of Search ..... 430/618, 619, 620, 531, 430/533, 538, 567, 523

[56] References Cited

U.S. PATENT DOCUMENTS 4,003,749 1/1977 Masuda et al. ..... 430/619

4,030,930 6/1977 Sashihara et al. ..... 430/619

*Primary Examiner*—Won H. Louie, Jr.

*Attorney, Agent, or Firm*—Sughrue, Rothwell, Mion, Zinn and Macpeak

[57] ABSTRACT

A thermally developable light-sensitive element comprising a support having in one or more layers thereon at least (a0) an organic silver salt, (b) light-sensitive silver halide grains and (c) a reducing agent, wherein the average grain size of the light-sensitive silver halide grains is not less than about 0.05 $\mu$ and the support is gas permeable and, in addition, carries thereon a subbing layer composed of at least one copolymer selected from the group consisting of a vinyl chloride type copolymer in which vinyl chloride is present in the copolymer in an amount of about 50 molar % or higher and a vinylidene chloride type copolymer in which vinylidine chloride is present in the copolymer in an amount of about 50 molar % or higher. The thermally-developable light-sensitive element of the invention is highly sensitive and in addition, has a good storage stability retaining on storage the properties possessed by the "fresh" photosensitive element even under high humidity and/or high temperature conditions.

31 Claims, No Drawings

THERMALLY-DEVELOPABLE LIGHT-SENSITIVE ELEMENTS

CROSS REFERENCE TO RELATED APPLICATION

This application is a continuation-in-part of U.S. Application Ser. No. 868,167 filed Jan. 9, 1978, now abandoned, by the present inventors.

BACKGROUND OF THE INVENTION

1. Field of the Invention

The present invention relates to a thermally-developable light-sensitive element, and more particularly to a high sensitivity thermally-developable photographic element in which the storage stability of the light-sensitive element is improved such that the photographic characteristics possessed by the light sensitive element immediately after production are retained (hereinafter "fresh characteristics"), even under high humidity and/or high temperature conditions.

2. Description of the Prior Art

Photography using silver halide has been carried out most widely hitherto, because silver halide photographic elements have superior photographic properties such as sensitivity and graduation to those possessed by light sensitive elements used in electrophotography or diazo photography. Recently, much research and development on methods for obtaining an image without using a wet processing with a developing solution or the like by changing the processing to a dry processing by heating or the like in the photographic process of forming an image on light-sensitive silver halide photographic elements has been carried out.

Of these light-sensitive photographic elements on which a photographic image can be formed using such a dry processing system, a thermally developable light-sensitive element using a composition containing an essential components, a silver salt of an organic acid, a small amount of silver halide and a reducing agent, e.g., as disclosed in U.S. Pat. Nos. 3,152,904 and 3,457,075, has been considered as being at present the most advanced photosensitive element. This thermally developable light-sensitive element is stable at normal temperature to about 50° C. However, silver is produced in the photographic element, when heated usually to about 80° C. or higher, more preferably to 100° C. or higher, following image-wise exposure to light, due to an oxidation-reduction reaction between the silver salt of the organic acid as an oxidant and the reducing agent in the light-sensitive layer with this oxidation-reduction reaction being caused by the catalytic action of metallic nuclei formed by the exposed silver halide in proximity to the oxidant and the reducing agent therein. As a result, the exposed areas of the thermally developable light-sensitive layer are rapidly blackened by the production of silver which results in an image formed due to a difference in the contrast between the exposed areas and the unexposed areas (background) thereof.

In the light-sensitive system, the silver halide remaining in the light sensitive element following development is not stabilized against light but allowed to be discolored by light. In spite of the discoloration, the system provides the same effects as those obtained in a system where silver halide is stabilized against light. The reason is because the silver salt present in the light sensitive element comprises a minor amount of silver halide and a major amount of a white or slightly colored organic silver salt which is relatively stable to light and is not thereby discolored, and even if a minor amount of silver halide is discolored by light, the light-sensitive layer remains white or only slightly colored overall, so that the minor amount of discoloration scarcely adversely affects the visual appearance.

The above-described thermally-developable light-sensitive element usually comprises a support having coated thereon the above-described thermally developable light-sensitive layer containing a silver salt of an organic acid, a silver halide and a reducing agent. A variety of materials can be employed as the photographic support and used appropriately depending upon how the thermally developable light-sensitive element is observed.

For example, various kinds of synthetic resin film supports which are disclosed in U.S. Pat. No. 4,039,334 all are employed as a support for a transparent type thermally-developable light-sensitive element. In contrast to this, where a reflection type thermally-developable light-sensitive element ordinarily used for copying documents is to be produced, a paper is most conventionally used as a support thereof due to low cost and ease of handling or the like.

In order to increase the sensitivity of the above-described thermally-developable light-sensitive element, a method which comprises employing a silver halide having a large grain size in the same manner as the sensitization of a conventional gelatin silver halide emulsion which is wet-processed is most effective.

Unexpectedly it was discovered that the employment of a silver halide having a large grain size, particularly an average grain size of about 0.05$\mu$ or greater in a thermally-developable light-sensitive element results in a deterioration of the storage stability of the fresh photosensitive element under conditions of high humidity and results in a reduction in the maximum image density in particular (see Comparative Example 1 give hereinafter).

As set forth hereinbefore the term "the storage stability of the fresh light sensitive element" as used herein means the ability of the photographic characteristics exhibited by a thermally-developable light-sensitive element immediately after the production thereof to be retained after storage for a long period of time. In addition, it has been found that the storage stability of the fresh light sensitive element tends to deteriorate more markedly where the support used in a gas permeable material such as a paper.

The above-described defects have been minimized by employing a support having thereon a subbing layer comprising a specific copolymer according to the present invention.

It was indeed known hitherto that a thermally-developable light-sensitive element can also contain various photograhic layers other than the thermally-developable light-sensitive layer, such as an uppermost protective layer, a subbing layer or a backing layer coated on the opposite surface of the support to the light-sensitive layer. However, it is quite unknown how the subbing layer of these photographic layers affects the thermally-developable light-sensitive element. In addition, even though U.S. Pat. No. 4,039,334, 3,761,279, etc., disclose use of various kinds of natural or synthetic polymers as a polymer for the subbing layer, all of these U.S. Patents are completely silent about what type of polymers are suitable for use in thermally development type photography and what effects are obtained thereby. These polymers disclosed therein also include those which have a weak heat resistance and therefore, may be transformed on heating, such as polyethylene and the like as disclosed in U.S. Pat. No. 3,761,279.

Further, generally the subbing layer is often used for the purpose of increasing the adhesion between a support and a specific layer to be adhered thereto (e.g., a photographic emulsion layer in a conventional silver halide photo-sensitive element and a thermally-developable light-sensitive layer in a thermally-developable light-sensitive element). However, the subbing layer in a thermally-developable light-sensitive element is not employed in many cases, since the thermally-developable light-sensitive layer by itself can adhere strongly to a support.

Still further, Japanese Patent Application (OPI) No. 43130/1976 discloses a thermally-developable light-sensitive element which comprises a support whose surface carries thereon a thermally-developable light-sensitive layer and in addition, the back thereof has a polymer layer thereon. This light sensitive element is prepared for the purpose of improvement in the storage stability of the fresh light sensitive element, when the light sensitive element is stored such that the above-described polymer backing layer and the thermally-developable light-sensitive layer are piled on each other and are in contact with each other (e.g., when the light-sensitive element is rolled up). However, it was surprising that the application of a polymer layer to the back of the support did not resolve the above-described defects (see Comparative Example 2 given hereinafter).

SUMMARY OF THE INVENTION

Accordingly, an object of the present invention is to provide a thermally-developable light-sensitive element wherein the deterioration in the storage stability of the fresh photosensitive element, which occurs when silver halide grains having a large grain size are used for the purpose of producing high sensitivity light sensitive elements, has been prevented.

Another object of the present invention is to provide a thermally-developable light-sensitive element wherein the above-described deterioration in the storage stability of the fresh light sensitive element which occurs remarkably, in particular when a gas-permeable support is used, has been prevented.

A further object of the present invention is to provide a thermally developable light-sensitive element which is highly sensitive and has good storage stability, retaining on storage the properties possessed by a "fresh" light-sensitive element under high humidity and/or high atmospheric temperature conditions, most especially such an element which exhibits an acceptable degree of thermal fog with the passage of time in combination with high sensitivity and good Dmax retention.

The objects of the present invention are attained by a thermally-developable light-sensitive element comprising a support having in one or more layers thereon at least (a) an organic silver salt, (b) light-sensitive silver halide grains and (c) a reducing agent, wherein the average grain size of the light-sensitive silver halide grains is about 0.05μ or larger and the support is gas-permeable and, in addition, carries thereon a subbing layer composed of at least one copolymer selected from the group consisting of a vinyl chloride type copolymer in which vinyl chloride is present in the copolymer in an amount of about 50 molar % or higher and a vinylidene chloride type copolymer in which vinylidene chloride is present in the copolymer in an amount of about 50 molar % or higher.

DETAILED DESCRIPTION OF THE INVENTION

The term "gas-permeable support" as used herein means a support material having therein a large number of pin-holds through which material a gas can be passed. The effect of the present invention is particularly marked when a water vapor-permeable support is used as the support. Examples of gas-permeable supports include a paper, a cloth (e.g., a cloth made of natural fibers such as cotton and wool, and a cloth made of synthetic fibers such as nylon and acrylic fibers), an unglazed plate such as a ceramic, and a porous synthetic high molecular weight sheet such as a "Microfilter", tradename for a sheet produced by the Fuji Photo Film Co., Ltd. A suitable thickness for flexible supports generally ranges from about 30μ to about 1000μ (1 mm) as is conventionally used. Of gas-permeable and flexible supports, a paper support is particularly preferred. Suitable paper supports which can be used in the present invention are those produced from various pulps, such as bond paper, kraft paper, Whatman paper, kent paper, etc. These papers may be surface-sized with a conventional sizing agent (e.g., starch, glue, a polysaccharide, carboxymethyl cellulose, a wax emulsion, polyvinyl alcohol, etc.) and also may contain a conventional filter (e.g., terra alba, talc, diatomaceous earth, etc.) The paper supports used in the present invention also include converted papers which are secondarily processed papers, such as a paper surface coated with a hydrophilic high-molecular weight compound (e.g., casein, starch, gelatin, polyvinyl alcohol, carboxymethyl cellulose, etc.), for example, art paper, coated paper, baryta paper, glassine paper, gelatin-subbed paper, polyvinyl alcohol-subbed paper and the like, a paper treated to render it electrically conductive by vacuum-depositing a metal thereon, or by embedding carbon particles therein. Further these papers may be subjected to a calendering. Some of these converted papers are those in which their gas-permeability is reduced. The deterioration of the storage stability of the fresh light sensitive element can not be prevented by the use of these manufactured papers, but can be prevented for the first time by further applying onto these converted papers a subbing layer which is used in the present invention.

Examples of vinyl chloride type copolymers and vinylidene chloride type copolymers which can be used as the subbing layer employed in the present invention include a copolymer of a vinyl ester and vinyl chloride, a copolymer of a methacrylate and vinyl chloride, a copolymer of an acrylate and vinyl chloride, a copolymer of a maleate and vinyl chloride, a copolymer of a fumarate and vinyl chloride, a copolymer of acrylonitrile and vinyl chloride, a copolymer of vinyl alkyl ether and vinyl chloride, a copolymer of vinyl chloride and vinylidene chloride, a copolymer of acrylonitrile and vinylidene chloride, and a copolymer of a vinyl ester and vinylidene chloride. Mixtures of these vinyl chloride type copolymers and vinylidene chloride copolymers can be used, if desired.

Suitable acids of the vinyl ester include carboxylic acids and sulfonic acids each having from 1 to 22 carbon atoms. Specific examples of vinyl esters which can be used include vinyl acetate, vinyl stearate, vinyl butyrate, vinyl propionate, vinyl (diethylphosphono) acetate, and vinyl butylsulfonate.

Suitable alcohols for the acrylate and the methacrylate, the maleate or the fumarate esters, include alcohols having 1 to 22 carbon atoms. Specific examples of suitable alcohols include methanol, ethanol, propanol, isopropanol, butanol, isobutanol, lauryl alcohol, stearyl alcohol, and 2,3-epoxypropanol.

The amount of the vinyl chloride or the vinylidene chloride to the other monomer and monomers used in the present invention can be varied over a wide range. Preferably the copolymers used contain about 50 mole percent or higher, more preferably from 70 to 98 mole percent, of vinyl chloride or vinylidene chloride.

Where a copolymer of vinyl chloride and vinylidene chloride is employed, use of from about 50 to about 98 mole percent of vinylidene chloride is preferred.

Suitable vinyl chloride type copolymers and vinylidene chloride type copolymers of the present invention include in addition to the copolymers set forth above terpolymers containing a small amount of maleic acid or a vinyl alcohol as a third comonomer. A suitable copolymerization molar ratio of the maleic acid or vinyl alcohol ranges from about 0.1 to about 3%.

The degree of polymerization of the copolymers which can be used in the present invention can be also varied widely. Generally, at least one copolymer selected from the group consisting of a vinyl chloride type copolymer and a vinylidene chloride type copolymer each having a degree of polymerization of about 30 or greater, more preferably from 50 to 50,000 can be used.

Specific examples of vinyl chloride type copolymers and vinylidene chloride type copolymers which can be used include a copolymer of vinyl acetate and vinyl chloride, a copolymer of vinyl stearate and vinyl chloride, a copolymer of vinyl butyrate and vinyl chloride, a copolymer of vinyl propionate and vinyl chloride, a copolymer of vinyl diethyl phosphonoacetate and vinyl chloride, a copolymer of vinyl butylsulfonate and vinyl chloride, a copolymer of methyl acrylate and vinyl chloride, a copolymer of ethyl acrylate and vinyl chloride, a copolymer of lauryl acrylate and vinyl chloride, a copolymer of 2,3-epoxypropyl methacrylate and vinyl chloride, a copolymer of diethyl fumarate and vinyl chloride, a copolymer of diethyl maleate and vinyl chloride, a copolymer of dibutyl maleate and vinyl chloride, a copolymer of vinyl isobutyl ether and vinyl chloride, a copolymer of allyl 2,3-epoxypropyl ether and vinyl chloride, a copolymer of chlorobutadiene and vinyl chloride, a copolymer of methyl acrylate and vinylidene chloride, and a copolymer of ethyl methacrylate and vinylidene chloride.

Of these copolymers, a copolymer of vinyl acetate and vinyl chloride and a copolymer of vinyl chloride and vinylidene chloride are most preferred in the present invention.

In accordance with the present invention, the storage stability of a fresh photosensitive element can be improved by providing a subbing layer of the copolymer set forth above between a gas-permeable support and a thermally developable light-sensitive layer.

On the other hand, in a thermally developable light-sensitive material having such a subbing layer undesirable spots (black spots having a higher optical density than that of the image obtained on development) or bubbles after development are formed. These defects are particularly remarkable in a thermally developable light-sensitive material having a subbing layer and a protective uppermost polymer layer as set forth hereinafter.

It has now been found, however, these disadvantages can effectively be prevented in the following manner, that is, initially by using a polyvinyl acetal and/or a higher alcohol in combination with the vinyl chloride type copolymer and/or the vinylidene chloride type copolymer as set forth above as a subbing layer, or secondly by using as a subbing layer a vinyl chloride type terpolymer and/or a vinylidene chloride type terpolymer containing maleic acid or vinyl alcohol as the third comonomer.

Polyvinyl acetals are generally called acetal resins, and those having a polymerization degree of about 200 to about 1,500, an acetalization degree of about 55 to about 90 wt.% and produced using an aldehyde having 2 to 5 carbon atoms (e.g., acetaldehyde, propionaldehyde, butyraldehyde, etc.) are preferred. Of these, polyvinyl butyral is particularly preferred. A suitable amount of the polyvinyl acetal is about 1 to 100 parts by weight, preferably about 5 to 30 parts by weight based on 100 parts by weight of the vinyl chloride type copolymer and/or the vinylidene chloride type copolymer.

Suitable higher alcohols which can be used in the present invention are higher alcohols having a melting point above about 40° C., preferably more than 60° C., such as pentadecyl alcohol, cetyl alcohol, heptadecyl alcohol, stearyl alcohol, nonadecyl alcohol, eicosyl alcohol, ceryl alcohol, melissyl alcohol, and the like. A suitable amount of the higher alcohol is about 0.01 to about 1 g/m$^2$, particularly about 0.05 to about 0.5 g/m$^2$.

In addition, it is surprising that a subbing layer of a vinyl chloride type terpolymer and/or a vinylidene chloride type terpolymer with maleic acid or vinyl alcohol as the third comonomer prevents the occurrence of spots or bubbles. Such are also included in the term vinyl chloride type copolymer and vinylidene chloride type copolymer as used herein.

The subbing layer which is used in the present invention can be prepared in a conventional manner, e.g., using a method which comprises dissolving one or more of the copolymers used in this invention as described above in a suitable solvent and then coating the thus obtained solution onto an gas permeable support. Known coating procedures such as dip coating, air knife coating, curtain coating, hopper coating, and extrusion coating all can be employed for the coating used in the present invention. Suitable solvents, which may be used,include cyclohexanone, methyl cyclohexanone, N,N-dimethylformamide, nitrobenzene, tetrahydrofuran, isophorone, mesityl oxide, dipropyl ketone, methyl amyl ketone, methyl isobutyl ketone, acetonyl acetone, methyl ethyl ketone, dioxane, dichloromethane, acetone, N,N-dimethylacetamide, and a mixture of these solvents.

The copolymer which is used in the present invention is preferably employed in an amount of from about 0.1 g to about 10 g, more preferably from 0.2 g to 3 g, per m$^2$ of the gas-permeable support.

Where the amount of these copolymers used is too small, the effects obtained in the present invention are reduced. On the other hand, where these copolymers are used in an excess amount, no additional effects are obtained over those with the use of the necessary amount of the copolymer, and use of an excess amount is not desired since this increases the cost.

The preferred amount of these copolymers used depends upon the type of gas-permeable support used, the photographic emulsion used and the additives in the photographic emulsion used.

The subbing layer composed of a vinyl chloride type copolymer and/or vinylidene type copolymer can contain various types of additives such as a matting agent, e.g. in an amount of preferably about 15% by weight or less based on the weight of the subbing layer, such as calcium carbonate, starch, titanium dioxide, zinc oxide, silica, dextrin, barium sulfate, alumina, kaolin, clay, and diatomaceous earth; and a fluorescent whitening agent, e.g., in an amount of about 0.1% by weight or less based on the weight of the copolymer component of the subbing layer, such as stilbenes, triazines, oxazoles, coumarins as disclosed in, for example, West German Patent Nos. 972,067, and 1,150,274, French Patent No. 1,530,244, U.S. Pat. Nos. 2,933,390, and 3,406,070. The subbing layer may also contain a thermal fog preventing agent and a toning agent as described hereinafter.

According to the present invention, a thermally developable light-sensitive layer containing components (a) to (c) as described hereinafter and optionally other additives is applied to the above-mentioned subbing layer. Components (a) to (c) and the other additives can be incorporated in two or more photographic layers on the subbing layer, if desired.

The organic silver salt, which is used as component (a) in the present invention, can be a colorless, white or slightly-colored silver salt, capable of reacting with a reducing agent, component (c), in the presence of exposed silver halide on heating at a temperature of about 80° C. or higher, preferably 100° C. or higher, and then forming silver (image). Suitable organic silver salts which can be used include silver salts of organic compounds having an imino group, a mercapto group, or a thione group. Specific examples of suitable organic silver salts include the following compounds:

(1) Silver salts of organic compounds having an imino group

For example, silver salts as disclosed in U.S. Pat. No. 4,099,039, e.g., silver salt of benzotriazole, silver salt of saccharin, silver salt of phthalazinone, and silver salt of phthalimide, etc.;

(2) Silver salts of compounds having a mercapto group or a thione group:

For example, silver salts as disclosed in U.S. Pat. Nos. 4,099,039, 3,933,507, and 3,785,830, e.g., silver salt of 2-mercaptobenzoxazole, silver salt of mercaptooxadiazole, silver salt of 2-mercaptobenzothiazole, silver salt of 2-mercaptobenzimidazole and silver salt of 3-mercapto-4-phenyl-1,2,4-triazole, etc.;

(3) Organic silver salts having a carboxyl group:

For example (A) Silver salts of aliphatic carboxylic acids; silver salts as disclosed in U.S. Pat. Nos. 4,099,039 and 3,457,075 and Japanese Patent Application (OPI) No. 99719/1975, e.g., silver laurate, silver myristate, silver palmitate, silver stearate, silver arachidonate, silver behenate, silver salts of aliphatic carboxylic acids having 23 or more carbon atoms, silver adipate, silver sebacate, and silver hydroxy stearate, etc.;

(B) Silver salts of aromatic carboxylic acids; silver salts as disclosed in U.S. Pat. No. 4,099,039 and Japanese Patent Application (OPI) No. 99719/1975, e.g., silver benzoate, silver phthalate, silver phenylacetate, and silver 4'-n-octadecyloxydiphenyl-4-carboxylate, etc.;

(4) Other silver salts:

For example, silver salts as disclosed in Japanese Patent Application (OPI) Nos. 22431/1976 and 93139/1970, e.g., silver 4-hydroxy-6-methyl-1,3,3,a,7-tetrazaindene, and silver 5-methyl-7-hydroxy-1,2,3,4,6-pentazaindene.

Of the above-described organic silver salts, an organic silver salt which is relatively stable to exposure to light is suitable. Even further, of these silver salts, a silver salt of a long-chaim aliphatic carboxylic acid having 10 to 40 carbon atoms, more preferably 18 to 33 carbon atoms is preferred. Specific examples of these organic silver salts include silver salts of carboxylic acids of the formula $CH_3(CH_2)_n$—COOH where n ranges from 16 to 31. In addition, a mixture of organic silver salts can be used, if desired. The amount of the organic silver salt used generally ranges from about 0.1 g to about 4 g, preferably from about 0.2 g to about 2.5 g of silver per $m^2$ of the support. When the amount of the organic silver salt used is less than about 0.1 $g/m^2$, the image density obtained is too low. On the other hand, even though an amount greater than about 4 $g/m^2$ is used, the image density obtained does not increase, and thus use of an excess results in a high cost due to an increased amount of silver used with no attendant advantages accruing.

These organic silver salts can be prepared using various methods e.g., as described in U.S. Pat. Nos. 3,457,075, 3,458,544, 3,700,458, and 3,839,049, British Patents Nos. 1,405,867 and 1,173,426, U.S. Pat. No. 4,099,039 and Japanese Patent Application No. 45997/1975. Generally, these methods of preparing an organic silver salt comprise mixing a liquid A wherein an organic silver salt-forming agent (e.g., an imino compound, a carboxylic acid, a mercapto compound and a salt thereof) is dissolved or dispersed in a suitable solvent (e.g., water, aliphatic hydrocarbons, esters, ketones, halogenated hydrocarbons, ethers, aromatic hydrocarbons, and alcohols and a liquid B wherein a silver ion providing agent (e.g., silver nitrate, silver trifluoroacetate, silver tetrafluoroborate, and silver perchlorate) is dissolved or dispersed in a suitable solvent (e.g., water, alcohol, acid amides, amines aqueous ammonia, ketones, acetonitrile, dimethyl sulfoxide, aromatic hydrocarbons, pyridine and aliphatic hydrocarbons). Specific examples of suitable solvents which can be used for solutions or dispersions A and B include toluene, xylene, water, cyclohexane, cyclohexene, dodecene, pentane, hexane, heptane, butyl acetate, amyl acetate, pentyl acetate, tricresyl phosphate, castor oil, methyl alcohol, ethyl alcohol, propyl alcohol, butyl alcohol, acetone, dioxane, methyl ethyl ketone, methyl isobutyl ketone, methylene chloride, dibutyl phthalate, N,N-dimethylformamide, ammonia and acetonitrile. No particular limitation on the solvent used exists in the present invention.

The reaction temperature can vary widely ranging from about −80° C. to about 100° C., preferably about −20° C. to about 70° C.

A suitable reaction time can also vary widely ranging from about 0.01 second to about 150 hours, preferably about 0.1 second to about 72 hours.

A wide range of reaction pressures can be used, e.g., a pressure of about $10^2$ mmHg to about 300 atmospheres, preferably at one atmosphere of pressure.

A suitable concentration of organic silver salt-forming agent in liquid A and concentration of the silver ion providing component in liquid B, each ranges from about $10^{-2}$% by weight to about $10^{2}$% by weight, more generally from about 1% by weight to about 50% by weight.

Ultrasonic vibration can be applied during the preparation the organic silver salt, as disclosed in British Patent No. 1,408,123.

In addition, in order to vary the form and/or the size of the organic silver salts obtained, and/or the photographic characteristics of the thermally developable light-sensitive material such as thermal stability, optical stability, fog and so on, polymers metal-containing compounds and surface active agents may also be present with the organic silver salt-forming components during the preparation of the organic silver salt. An example of such a polymer is polyvinyl butyral as disclosed in U.S. Pat. No. 3,700,458 and Japanese Patent Application No. 133692/75. Examples of metals present in the above-described metal-containing compounds include not only mercury, lead, chromium, cobalt and rhodium, as disclosed in British Patent No. 1,378,734, Japanese Patent Application (OPI) Nos. 22430/76, 116024/75 and 134421/75, but also manganese, nickel, iron and cerium. The surface active agents and polymers each are employed in amounts ranging from about 0.1 g to about 1,000 g and, preferably about 1 g to about 500 g, per mol of the organic silver salt. The metal-containing compound is employed in an amount ranging from about $10^{-6}$ mol to about $10^{-1}$ mol per mol of the organic silver salt and in an amount ranging from about $10^{-5}$ mol to about $10^{-2}$ mol per mol of silver halide.

A preferred grain size fo the thus-obtained organic silver salt ranges from about 10 microns to about 0.01 micron and, more particularly, about 5 microns to about 0.1 micron, in length. Suitable examples of light-sensitive silver halides as component (b) of the present invention include silver chloride, silver bromide silver iodide, silver chloroiodobromide, silver chlorobromide, silver iodochloride, silver iodobromide and mixtures thereof. The silver halide is employed in an amount ranging preferably from about 0.001 mol to about 0.5 mol and particularly from about 0.01 mol to about 0.3 mol per mol of the organic silver salt.

A silver halide having an average grain size of about 0.05$\mu$ or larger, preferably from 0.05$\mu$ to 5$\mu$, is used in the present invention. The average grain size of the silver halide can be measured according to the method as disclosed in CEK Mees & TH James, *The Theory of the Photographic Process,* 3rd Ed. pp. 36 to 43, MacMillan Company (1966). Namely, the average grain size is determined by a method which comprises the steps of photographing the silver halide grains using a microscope, preferably an electron microscope, and then measuring the size of the silver halide grains, e.g., the length of the side thereof where the silver halide grains are cubic, or triangular tablets, while the diameter thereof where the silver halide grains are hexagonal tablets or spherical. The average grain size can be determined by means of a histogram (size-frequency curve) where the grain size distribution of the silver halide grains is wide. On the other hand, where the grain size distribution is narrow, a histogram need not be prepared.

The light-sensitive silver halide component (b) can be prepared in the form of a photographic emulsion using any procedures well-known in the photographic art, such as the single jet method and the double jet method. Suitable emulsions include a Lippmann emulsion, an emulsion prepared by an ammonia process and thiocyanate or thioether ripened emulsions, such as those described in U.S. Pat. Nos. 2,222,264, 3,320,069 and 3,271,157. Of these types of emulsions, those wherein the silver halide has a grain size of about 0.05$\mu$ or larger can be used in the present invention.

The light-sensitive silver halide, component (b), thus prepared can be then mixed with an oxidation-reduction composition comprising the organic silver salt component (a) and the reducing agent component (c). Description of mixing techniques are given in U.S. Pat. No. 3,152,904.

In addition, various methods of ensuring sufficient contact of the silver halide with the organic silver salt have been proposed hithertofore. One of these methods comprises employing a surface active agent, as specifically disclosed in, for example, U.S. Pat. No. 3,761,273, Japanese Patent Application (OPI) Nos. 32926/1975, and 32928/1975. Another method comprises preparing a silver halide in the presence of a polymer and then mixing the silver halide composition with an organic silver salt as discslosed in, for example, U.S. Pat. Nos. 3,706,565, 3,706,564, and 3,713,833 and British Patent No. 1,362,970. Still another method comprises dissolving a silver halide emulsion with an enzyme and then mixing the silver halide composition with an organic silver salt, as disclosed in British Patent No. 1,354,186. The silver halide which is used in the present invention can be prepared substantially simultaneously with the organic silver salt, Component (a).

Still another method which can be used comprises preparing a solution or dispersion of an organic silver salt, or, alternatively, incorporating an organic silver salt in a sheet material followed by addition of a light-sensitive silver halide-forming component, as hereinafter described, and then converting a portion of the organic silver salt to a light-sensitive silver halide (this method is referred to as a halidation method). U.S. Pat. No. 3,457,075 discloses that the silver halide is in effective contact with the organic silver salt and functions excellently.

The component capable of forming a light-sensitive silver halide (hereinafter silver halide forming component) is a compound which reacts with an organic silver salt and produces a silver halide. Which compounds can be suitably used and function effectively can be determined by the following simple and routine test. More specifically, a test compound is contacted with an organic silver salt, optionally after heating, and then an X-ray diffraction analysis is conducted to determine whether a diffraction peak intrinsic to silver halide is present or not.

Suitable light-sensitive silver halide-forming components which can be used include inorganic halides, halogen-containing metal complexes, onium halides, halogenated hydrocarbons, N-halo compounds and other halogen-containing compounds. Specific examples of suitable components are described in detail in U.S. Pat. Nos. 4,099,039 and 3,457,075, Japanese Patent Application (OPI) Nos. 78316/1975, 115027/1975 and 9813/1976. Some specific examples thereof are given below.

(a) Inorganic halides, e.g., represented by the formula:

$$MX_n$$

wherein M represents H, $NH_4$ or a metal atom, X represents Cl, Br or I, and n is 1 when M is H or $NH_4$, or the valence of M when M is a metal atom. Specific examples of metals M in such halides include lithium, sodium, potassium, rubidium, cesium, copper, gold, beryllium, magnesium, calcium, strontium, barium, zinc, cadmium, mercury, aluminum, gallium, indium, lanthanum, ruthenium, thallium, germanium, tin, lead, antimony, bismuth, chromium, molybdenum, tungsten, manganese, rhenium, iron, cobalt, nickel, ruthenium, rhodium, palladium, osmium, iridium, platinum, cerium and so on.

(b) Halogen-containing metal complexes, specific examples of which include $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_2RhCl_6$, $(NH_4)_3RhBr_6$ and so on.

(c) Onium halides, specific examples of which include trimethylphenylammonium bromide, cetylethyldimethylammonium bromide, trimethylbenzylammonium bromide and other quaternary ammonium halides; quaternary phosphonium halides such as tetraethylphosphonium bromide; tertiary sulfonium halides such as trimethylsulfonium iodide; and so on.

(d) Halogenated hydrocarbons, specific examples of which include iodoform, bromoform, carbon tetrabromide, 2-bromo-2-methylpropane and so on.

(e) N-halo compounds, specific examples of which include N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetanilide, N,N-dibromobenzenesulfonamide, N-bromo-N-methylbenzenesulfonamide, 1,3-dibromo-4,4-dimethylhydantoin, trichloroisocyanuric acid and so on.

(f) Other halogen-containing compounds such as triphenylmethyl chloride, triphenylmethyl bromide, 2-bromobutyric acid, 2-bromoethanol, brnzophenone dichloride, triphenyl bromide and so on.

In the above-described processes, the silver halide-forming components can be used individually or as a combination thereof. A suitable amount of the silver halide-forming component ranges from about 0.001 mol to about 0.7 mol, and preferably about 0.01 mol to about 0.5 mol, per mol of the organic silver salt used as component (a). Use of an amount less than about 0.001 mol results in a low sensitivity, while use of a larger amount than about 0.7 mol causes an undesirable coloration in the background of the processed light-sensitive material when the materials are allowed to stand for a long time, as they are, and then exposed to normal room illumination.

Suitable silver halide-forming conditions are set forth below. A suitable reaction temperature ranges from about −80° C. to about 100° C., preferably from about −20° C. to about 70° C. An appropriate reaction time ranges from about 0.01 second to about 150 hours, preferably from about 0.1 second to about 72 hours. The reaction pressure can range from about $10^{-2}$ mm Hg to about 300 atmospheres and, preferably, is at a pressureof 1 atmosphere.

In these halidation methods, the average grain size of the silver halide produced can be increased to about 0.05μ or larger by an appropriate selection of processing conditions such as the temperature of the halidation, the pH and pAg during the halidation, the halidation agent used, and the solvent or binder capable of dispersing the organic silver salt therein, addition of a compound capable of forming a coordination compound with silver ion, control of the defects in the organic silver salt grains by an appropriate method of preparing an organic silver salt grains, or the like. The optimum comditions for the halidation method depend to a very great extent upon the desired average grain size of the silver halide and the type of organic silver salt used. Accordingly, the optimum conditions for the halidation method must be determined experimentally. However, the procedures for determining these conditions can be easily conducted by one skilled in the art.

The silver halide produced using any of the methods can be sensitized with, for example, a sulfur-containing compound, a gold compound, a platinum compound, a palladium compound, a silver compound, a tin compound, or a mixture thereof. Sensitization is described in detail in, for example, Japanese Patent Application (OPI) Nos. 115386/1974, 122902/1974, 143178/1974, 13074/1975, 45646/1975, and 81181/1975.

An improvement in the sensitivity of the silver halide can be attained, for example, using a method which comprises forming a silver halide in the presence of a portion of the binder, precipitating the silver salt (silver halide and organic silver salt) by means of, for example, a centrifuge, and then re-dispersing the silver halide (silver halide and organic silver salt) into the remaining portion of the binder, in other words by use of the floculation method ordinarily used in producing a gelatin silver halide photographic emulsion.

In addition, the photographic properties can be changed in the co-presence of nitric acid, potassium ferricyanide, thiocyanates, thiosulfates, benzotriazole, tetrazaindenes, mercapto compounds, thione compounds, iodides, or heavy metal salts such as rhodium salts during the re-dispersion.

Some optical sensitizing dyes which are effective for gelatin-silver halide emulsions can also be used to achieve a sensitizing effect with the thermally developable light-sensitive materials of the present invention. Examples of effective, optical sensitizing dyes include cyanine, merocyanine, rhodacyanine, complex (tri- or tetra-nuclear) cyanine or merocyanine, holopolar cyanine, styryl, hemicyanine, oxonol, hemioxonol and xanthene dyes. Those cyanine dyes which contain basic nuclei such as thiazoline, oxazoline, pyrroline, pyridine, oxazole, thiazole, selenazole and imidazole nuclei are more preferred. Particularly, cyanine dyes containing imino groups or carboxy groups are effective. Merocyanine dyes may contain acidic nuclei such as thiohydantoin, rhodanine, oxazolidinedione, thiazolizinedione, barbituric acid, thiazolinone, malononitrile and pyrazolone nuclei, in addition to the above-described basic nuclei. Merocyanine dyes containing imino or carboxy groups are particularly effective. Specific examples of particularly effective sensitizing dyes for the thermally developable light-sensitive materials of the present invention include merocyanine dyes containing rhodanine, thiohydantoin or 2-thio-2,4-oxazo-lidinedione nuclei, e.g., as disclosed in U.S. Pat. No. 3,761,279, Japanese Patent Application (OPI) No. 105127/75 and Japanese Patent Application (OPI) No. 104637/75.

Further, examples of other sensitizing dyes which may be employed in the present invention include trinuclear merocyanine dyes as disclosed in U.S. Pat. No. 3,719,495; sensitizing dyes mainly effective for silver iodide as disclosed in Japanese Patent Application (OPI) No. 17719/74; dyes of the styrylquinoline system as disclosed in British Patent No. 1,409,009; rhodacyanine dyes as disclosed in U.S. Pat. No. 3,877,943; acidic dyes such as 2',7'-dichlorofluorescein dye as disclosed in Japanese Patent Application (OPI) Nos. 96717/74 and 102328/74, and British Patent No. 1,417,382; and merocyanine dyes as disclosed in Japanese Patent Application (OPI) Nos. 156424/75 and 101680/74.

A suitable amount of these sensitizing dyes is about $10^{-4}$ mol to about 1 mol per mol of the silver halide or the silver halide-forming component, component (b).

Suitable reducing agents, which are used as component (c) of the present invention, are those which are capable of reducing the organic silver salts used [component (a)] in the presence of the exposed silver halide [component (b)], when the redox system is heated. The selection of the reducing agent to be employed depends upon the kinds and oxidizing ability of the organic silver salt with which it is used in combination.

Examples of reducing agents suitable for use include mono-, bis-, tris- or tetrakis-phenols; mono- or bis-naphthols; di- or poly-hydroxynaphthalenes; di- or poly-hydroxybenzenes; hydroxymonoethers; ascorbic acids; 3-pyrazolidones,; pyrazolines; pyrazolones; reducing saccharides, phenylenediamines, hydroxylamines; reductones; hydroxyaminic acids; hydrazides; and N-hydroxyureas. Specific examples of these reducing agents are described in detail in, e.g., Japanese Patent Application (OPI) No. 22431/76, U.S. Pat. Nos. 3,615,533, 3,679,426, 3,672,904, 3,751,252, 3,751,255, 3,782,949, 3,801,321, 3,794,488 and 3,893,863, Belgian Patent No. 786,086, U.S. Pat. Nos. 3,770,448, 3,819,382, 3,773,512, 3,928,686, 3,839,048 and 3,887,378, Japanese Patent Application (OPI) Nos. 15541/75 and 36143/75, U.S. Pat. No. 3,827,889, Japanese Patent Application (OPI) Nos. 36110/75, 116023/75, 147711/75 and 23721/76, and Japanese Patent Applications Nos. 105290/74 and 126366/74.

Polyphenols, sulfonamidophenols and naphthols, of these compounds, are particularly preferred as reducing agents.

Preferred examples of polyphenols are 2,4-dialkyl-substituted orthobisphenols, 2,6-dialkyl-substituted parabisphenols or mixtures thereof. Specific examples of such compounds include 1,1-bis(2-hydroxy-3,5-dimethylphenyl)-3,5,5-trimethylhexane, 1,1-bis(2-hydroxy-3-t-butyl-5-methylphenyl)-methane, 1,1-bis(2-hydroxy-3,5-di-t-butylphenyl)methane, 6-methylenebis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane and 2,2-bis(4-hydroxy-3,5-di-t-butylphenyl)propane.

Preferred examples of naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-dinaphthyl and so on.

Preferred examples of sulfonamidophenols include 4-benzenesulfonamidophenol, 2-benzenesulfonamidophenol, 2,6-dichloro-4-benzenesulfonamidophenol and the like.

In addition to the above-described specific examples, more detailed examples are described in Japanese Patent Application (OPI) Nos. 22431/75, 36110/75, 116023/75, 147711/75 and 23721/76, Japanese Patent Applications Nos. 105290/75 and 126366/74, Japanese Patent Application (OPI) No. 15541/75, and U.S. Pat. Nos. 3,672,904 and 3,801, 321.

In addition, colored images can be obtained when phenylenediamines are employed as a reducing agent and phenolic or active methylenic color couplers as disclosed in U.S. Pat. Nos. 3,531,286 and 3,764,328 are used in combination with the phenylenediamines. Similarly, colored images can be also obtained using the process as disclosed in U.S. Pat. No. 3,761,270.

Of these reducing agents, mono-, bis-, tris- or tetrakis-phenols having at least one alkyl group substituent, such as a methyl group, an ethyl group, a propyl group, an isopropyl group or a butyl group, or an acyl group substituent at a position adjacent the position substituted with a hydroxy group, where the hydroxy group is connected to a carbon atom in the aromatic nucleus, for instance, a 2,6-di-t-butylphenol group, are particularly advantageous, since they are stable to light and, therefore, only a slight coloration at the back-ground of the processed thermally developable light-sensitive materials occurs.

In addition, reducing agents of the kind which undergo photolysis and are rendered inert to light as disclosed in U.S. Pat. No. 3,827,889 are suitable for use, since coloration at the background of the processed thermally developable light-sensitive materials, which is caused by unreacted redox components gradually undergoing a redox reaction upon exposure to normal room illumination upon storage, can be prevented from occurring because of the decomposition or the inactivation of such reducing agents by light. Examples of photolytic reducing agents which can be used include ascorbic acid or derivatives thereof, furoin, benzoin, dihydroxyacetone, glyceraldehyde, tetrahydroxyquinone rhodizonate, 4-methoxy-1-naphthol and aromatic polysulfur compounds as disclosed in Japanese Patent Application (OPI) No. 99719/875. Direct positive images can be produced when thermally developable light-sensitive materials are prepared using reducing agents capable of undergoing photolysis and, then, are image-wise exposed to light to destroy the reducing agents. Further, photolysis-accelerating agents can be used in combination with such reducing agentss, if desired.

A suitable reducing agent is selected from the above described reducing agents by taking into account the kind (ability) of the organic silver salt employed in combination therewith. For instance, reducing agents possesssing strong reducing activity are suitable for use with silver salts which are comparatively difficult to reduce, such as silver benzotriazole and silver behenate. On the other hand, for relatively easily reducible organic silver salts such as silver caprate and silver laurate, comparatively weak reducing agents are suitable. Specific examples of appropriate reducing agents for silver benzotriazole include 1-pheny-3-pyrazolidones, ascorbic acid, ascorbic acid monocarboxylic acid esters, and naphthols such as 4-methoxy-1-naphthols. Suitable reducing agents for silver behenate are o-bisphenols of the bis(hydroxyphenyl)methane system, hydroquinone and other various kinds of reducing agents. Suitable examples of reducing agents for silver caprate and silver laurate and substituted tetrakisphenols, o-bisphenols of the bis(hydroxyphenyl)alkane system, p-bisphenols such as substituted compounds of bisphenol A and p-phenylphenol.

The simplest method for choosing a suitable reducing agent by one skilled in the art is by trial and error, wherein light-sensitive materials are prepared, e.g., as described in the examples hereinafter, and the photographic characteristics examined. The suitability or lack of suitability of the reducing agents used is determined by the results obtained.

The amount of the reducing agent employed will vary depending upon the kind of organic silver salt and the reducing agent used, and the presence of other additives. However, in general, amounts of about 0.05 to about 10 mol, and preferably about 0.1 to 3 mol, per mol of the organic silver salt are suitable.

The above-described, various types of reducing agents may be used alone or as a combination thereof, if desired.

A toning agent can be used in the thermally developable light-sensitive element of the present invention.

A toning agent is preferably used where a dark, particularly black, image is desired. The amount of the toning agent used ranges from about 0.0001 mol to about 2 mol, preferably from about 0.0005 mol to about 1 mol, per mol of the organic silver salt. Most conventional toning agents are imino compounds and mercapto compounds, although the effectiveness of the toning agent depends upon the types of the organic silver salt and the reducing agent with which the toning agent is used in combination.

Phthalazinones, oxazinediones, cyclic imides, urazoles, 2-pyrazoline-5-one and the derivatives thereof can be used as a suitable toning agent. Specific examples of toning agents are described in detail in U.S. Pat. Nos. 3,846,136, 3,782,941, 3,844,797 3,832,186, 3,881,938 and 3,885,967, British Patent No. 1,380,795, Japanese Patent Application (OPI) Nos. 151138/1975, 91215/1974, 67132/1975, 67641/1975, 114217/1975, 32927/1975, 22431/1975, and 16128/1976. Some specific illustrative examples of toning agents include phthalazinone, N-acetylphthalazinone, N-hydroxyethylphthalazinone, phthalimide, N-hydroxyphthalimide, benzoxadinedione, uracil and the like.

Improvement in photographic properties such as the storage stability of the fresh photosensitive element can be often be attained using a combination of two or more types of these toning agents.

A variety of methods of preventing thermal fog can be used with the light-sensitive thermally developable photographic element of the present invention. One of these methods comprises using a mercury compound as disclosed in U.S. Pat. No. 3,589, 903. Preferred mercury compounds are mercury bromide, mercury iodide and mercury acetate. A second method of preventing thermal fog involves the use of an N-halo compound such as an N-halo succinic acid and a N-halo acetamide as disclosed in Japanese Patent Application (OPI) Nos. 10724/1974, 97613/1974, 90118/1974, and 22431/1976. Another method of preventing thermal fog comprises use of a compound as disclosed in U.S. Pat. No. 3,885,968, Japanese Patent Application (OPI) Nos. 101019/1975, 116024/1975, 123331/1975, and 134421/1975, Japanese Patent Application Nos. 121631/1974, 115781/1974, 125037/1974, 131827/1974, 299/1975, 28851/1975, and 96155/1975, with examples including a lithium salt, a peroxide, a persulfate, a rhodium salt, a cobalt salt, a palladium compound, a cerium compound, sulfinic acids, thiosulfonic acids, disulfides, rhodinic acid and a polymer having acidic group(s). Particularly preferable compounds are sodium benzenesulfinate, sodium p-toluenesulfinate, sodium benzenethiosulfonate, cerium compounds (e.g., cerium nitrate, cerium bromide, etc.), an acetylacetonato palladate comples, a fatty acid, and the like. Other specific examples of preferred compounds are described in Japanese Patent Application (OPI) Nos. 22431/1976.

In order to prevent light-disoloration of the exposed thermally developable light-sensitive element (which gradually occurs resulting in discoloration when exposed to normal room illumination following the development processing), effective compounds which can be used include, for example, a precursor of a stabilizing agent such as an azolethioether and the blocked arolethiones as disclosed in U.S. Pat. No. 3,839,041, a tetrazolylthio compound as disclosed in U.S. Pat. No. 3,700,457, a halogen-containing light-sensitive organic oxidizing agent as disclosed in U.S. Pat. No. 3,707,377, a halogen-containing compound as disclosed in Japanese Patent Application (OPI) No. 119624/1975 and U.S. Patent 3,874,946, 1-carbamoyl-2-tetrazolin-5-thione and the derivatives thereof as disclosed in U.S. Pat. No. 3,893,859, and sulfur as disclosed in Japanese Patent Application (OPI) No. 26019/1976.

Each component which is used in the present invention is dispersed in at least one colloid as a binder. Preferred binders are generally hydrophobic, however, hydrophilic binders may be used. These binders are transparent or semitransparent, with examples including natural polymers, e.g., proteins such as gelatin, cellulose derivatives; polysaccharides such as dextran; and gum arabic, and synthetic polymers. Preferred binders are described in U.S. Pat. No. 4,099,039. Particularly preferred binders include, for example, polyvinyl butyral, polyvinyl acetate, ethyl cellulose, polymethyl methacrylate, cellulose acetate butyrate, gelatin and polyvinyl alcohol. Two or more of these binders can be optionally used in combination, if desired. The weight ratio of the binder used generally ranges from about 10:1 to about 1:10, preferably from about 4:1 to about 1:4, to the weight of the organic silver salt, component (a).

In addition, a protective uppermost polymer layer can be optionally provided on the thermally developable light-sensitive layer with the intention of increasing the transparency of the thermally developable light-sensitive layer and of improving the thermal resistance thereof. A suitable thickness of the protective uppermost polymer layer ranges from about 1 micron to about 20 microns. Examples of polymers suitable for the protective uppermost polymer layer include polymers as described in U.S. Pat. No. 3,933,508, e.g. polyvinyl chloride, a vinylidene chloride-vinyl chloride copolymer, polyvinyl acetate, a vinyl chloride-vinyl acetate copolymer, polystyrene, methyl cellulose, ethyl cellulose, cellulose acetate butyrate, cellulose acetate, vinylidene chloride, polycarbonate, gelatin and polyvinyl alcohol.

The protective uppermost polymer layer may contain some or all of the reducing agent (c) set forth above. However, it is preferred for at least about 50% of the reducing agent to be present in a layer containing components (a) and (b), i.e., to be in the thermally developable light-sensitive layer. The protective uppermost polymer layer may further contain a toning agent or a thermal fog preventing agent.

A preferred embodiment of the present invention is a thermally developable light-sensitive element comprising a gas-permeable support having thereon, in order a subbing layer comprising a vinyl chloride type copolymer and/or a vinylidene chloride type copolymer, and a thermally developable light-sensitive layer containing component (a), (b) and (c).

Another preferred embodiment is a thermally developable light-sensitive element comprising a gas-permeable support having thereon, in order, a subbing layer comprising a vinyl chloride type copolymer and/or a vinylidene chloride type copolymer mixed with a polyvinyl acetal and/or a higher alcohol, a thermally developable light-sensitive layer containing components (a), (b) and (c), and a protective uppermost polymer layer.

A further preferred embodiment is a thermally developable light-sensitive element having a gas-permeable support having thereon, in order, a subbing layer comprising a vinyl chloride type copolymer and/or a vinylidene chloride type terpolymer containing maleic acid or vinyl alcohol as the third comonomer, a thermally developable light-sensitive layer containing components (a), (b) and (c), and a protective uppermost polymer layer.

The method of producing the thermally developable light-sensitive element of the present invention is given below for the purposes of illustration. Herein, all parts, percents, ratios and the like are by weight unless otherwise indicated.

A coating solution containing at least one copolymer selected from the group consisting of a vinyl chloride type copolymer and a vinylidene chloride type copolymer is applied on a paper support as a gas-permeable support in order to provide a subbing layer thereon. Any coating methods can be used. Namely, dip coating, air knife coating, curtain coating, hopper coating, the coating methods as disclosed in U.S. Pat. No. 2,761,791 and British Patent No. 837,095, and the like can be employed.

A backing layer can be optionally provided on the back of the paper support (i.e., the opposite side to the surface on which the subbing layer is coated).

Separately, an organic silver salt is prepared by reacting an organic silver salt forming agent and a silver ion-providing agent (e.g., silver nitrate) using any of the various methods as described hereinbefore. The thus-prepared organic silver salt is washed with water and/or an alcohol such as methanol, ethanol, etc., and then dispersed in a binder for a photographic emulsion. A mechanical dispersion means such as a colloid mill, a mixer and a ball mill can be used. To the thus-obtained polymer dispersion of the organic silver salt, is added a silver halide-forming agent and then a portion of the organic silver salt is converted to silver halide. Alternatively, a previously prepared silver halide can be added to the polymer dispersion of the organic silver salt, or both the silver halide and the organic silver salt can be prepared at the same time. After that, a variety of additives such as a sensitizing dye, a reducing agent and a toning agent and added in sequence, preferably in the form of a solution to the polymer dispersion of the silver salt, which results in a finished coating composition for a thermally developable light-sensitive element.

The thus-prepared coating composition is coated on the above-described subbing layer without drying, to form a thermally developable light-sensitive layer. The thermally developable light-sensitive layer can be also coated using a variety of methods as described hereinbefore as to the coating of the subbing layer. An uppermost polymer layer (protective layer) is optionally superimposed on the thermally developable light-sensitive layer.

The coating composition such as those for the subbing layer, the thermally developable light-sensitive layer and the uppermost layer, respectively, can be coated in sequence on a paper support. Alternatively, two or more of these coating compositions can be coated on the paper support at the same time, which results in the formation of two or more layers simultaneously.

The surface or the back of the support, or alternatively a layer coated on the support, can be optionally printed, so that a specific design thus printed thereon can enable the thermally developable light-sensitive of this invention to be used as a (commutation) ticket, a post card and the like.

The thus prepared thermally developable light-sensitive element is cut into pieces having a size suitable for the end-use and then image-wise exposed to light. The photographic element can be optionally previously heated prior to exposure at a temperature of from about 80° C. to about 140° C. Suitable light sources which can be used for the image-wise exposure include a variety of light sources such as a tungsten lamp, a fluorescent lamp for copying as mainly used for exposure of diazo photosensitive elements, a mercury lamp, an iodo lamp, a xenon lamp, a CRT light source and a laser light source. A photographic image having gradation as well as a line image such as a drawing can be used as an original. In addition, people and/or landscapes can be also photographed by exposure of the thermally developable light-sensitive element in a camera.

Suitable printing methods which can be used include contact printing comprising placing an original directly on the light sensitive element, reflection type printing and enlargement printing. Since the thermally developable light-sensitive element of this invention has high sensitivity, merely an exposure amount ranging from about 10 to about 300 lux. sec. can be used for exposure of the element. The light-sensitive element thus image-wise exposed can be developed simply by heating at a temperature of from about 80° C. to about 180° C., preferably from about 100° C. to about 150° C. The heating time can be optionally adjusted, for example, within a period of time ranging from 1 to 60 seconds. The heating time is dependent upon the heating temperature used. A variety of heating means can be used. For example, the light-sensitive element can be contacted with a simple heated plate or with a heated drum, or alternatively the light-sensitive element can be passed through a heated space. In addition, the light-sensitive element can be heated using high frequency heating or a laser beam as disclosed in U.S. Pat. No. 3,811,885. In order to prevent an odor which occurs on heating from being detected, a deodorizing agent can be installed in the processing device. In addition, in order not to perceive an odor emitted from the light-sensitive element, certain types of perfume can be also incorporated therein.

The thermally developable light-sensitive element of the present invention is very useful because it is highly sensitive and in addition, it has superior storage stability in terms of the properties of the fresh light-sensitive element being retained on storage under high humidity and/or high temperature conditions.

The present invention is illustrated in greater detail below by reference to the following Examples. Unless otherwise indicated herein, all parts, percents, ratios and the like are by weight.

EXAMPLE 1

A subbing layer was formed by coating a methyl ehtyl ketone solution containing three percent by weight of a copolymer of vinyl chloride and vinyl acetate (MA-800 S lot. No. 6709, manufactured by Shinetsu Kagaku Co., Ltd.; average monomer molar ratio of vinyl chloride to vinyl acetate; 90:10:average polymerization degree; 780) on a paper support wherein the surface of the paper support for a pressure-sensitive copying paper had been sized with polyvinyl alcohol (about 1 g per $m^2$) in an amount of about 1.5 f of the copolymer per $m^2$ of the paper support.

Next, a coating composition for a thermally developable light-sensitive layer was prepared in accordance with the following procedures. 34 g of behenic acid and 500 ml of water were mixed and then behenic acid was dissolved on heating at 85° C. To the mixture of behenic acid thus dissolved and water, was added a sodium hydroxide aqueous solution (2.0 g of sodium hydroxide and 50 cc of water) at 25° C. over a period of three minutes while stirring at 1800 rpm, which resulted in the formation of a mixture of sodium behenate and behenic acid, followed by cooling from 85° C. to 30° C. while stirring at 1800 rpm.

After that, a silver nitrate aqueous solution containing 8.5 g of silver nitrate and 50 cc of water was added to the mixture at 25° C. over a period of three minutes while continuing the stirring and then the reaction system was further stirred for 90 minutes. The silver behenate particles thus produced in the reaction mixture were recovered by adding 200 cc of isoamyl acetate thereto, and then a polymer dispersion of silver behenate was prepared by dispersing the silver behenate in an isopropanol solution containing DENKA BUTYRAL 4000-2 (tradename for a polyvinyl butyral produced by Tokyo Denki Kagaku K.K.) (25 g of polyvinyl butyral and 200 cc of isopropanol) using a homogenizer.

Next, to the polymer dispersion of silver behenate maintained at 50° C. while stirring at 500 rpm, was added an acetone solution containing N-bromosuccinimide (0.7 g of N-bromosuccinimide and 50 cc of acetone) at 25° C. over a period of 90 minutes and the reaction system was further stirred for 60 minutes resulting in the preparation of a polymer dispersion of both silver bromide and silver behenate. The average grain size (measured microscopically using transmitted light) of the silver bromide grains was about 0.06μ.

On twelveth by weight (i.e., 1/240 mole) of the polymer dispersion of silver bromide and silver behenate thus prepared was weighed out. To this portion maintained at 30° C. while stirring at 200 rpm, was added the components illustrated below in the order listed below at intervals of five minutes, so that a coating composition was prepared.

(i) Merocyanine Dye (sensitizing dye) having the following formula:

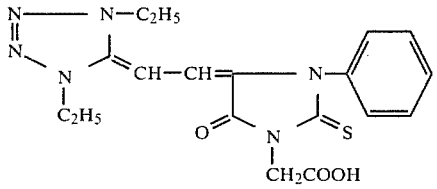

(2ml of a 0.025 percent by weight methyl Cellosolve solution)

(ii) Sodium Benzenethisulfonate (2 ml of a 0.01 percent by weight methanol solution)

(iii) m-Nitrobenzoic Acid (2 ml of a 0.5 percent by weight ethanol solution)

(iv) Phthalazinone (5 ml of a 4.5 percent by weight methyl Cellosolve solution)

(v) Phthalimide (10 ml of a 4 percent by weight methyl Cellosolve solution)

(vi) o-Bisphenol (reducing agent) having the following formula:

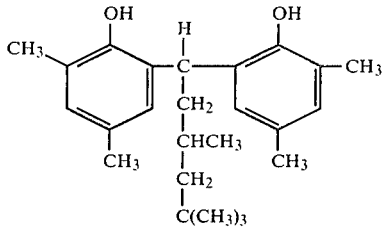

(10 ml of a 10 percent by weight acetone solution)

Thermally Developable Light-Sensitive Element (A) was prepared by coating the thus prepared coating composition on the subbing layer as described above comprising the copolymer of vinyl chloride and vinyl acetate applied to the papr support in an amount of about 0.3 g of silver per square meter of the support.

For comparison, Thermally Developable Light-Sensitive Element (B) was prepared by coating the above-described coating composition on a paper support which did not have a subbing layer as described above comprising a copolymer of vinyl chloride and vinyl acetate (i.e., a paper support wherein the surface of the base paper for a pressure-sensitive copying paper was simply sized with polyvinyl alcohol) in an amount of about 0.3 g of silver per square meter of the support.

These two types of Thermally Developable Light-Sensitive Elements (A) and (B) this prepared were each exposed to light from a tungsten lamp through a step wedge. The maximum exposure amount was 3000 CMS. After that, Thermally Developable Light-Sensitive Elements (A) and (B) were each contacted with a heated plate at 130° C. for 8 seconds for development by heating.

In addition, these two types of Thermally Developable Light-Sensitive Elements (A) and (B) were each stored for 14 days under conditions of a temperature of 35° C. and a relative humidity of 80% (this storage procedure is hereinafter referred to as a forced deterioration test). Subsequently, these Thermally Developable Light-Sensitive Elements (A) and (B) were exposed under the same conditions as described above and then developed on heating. Photographic properties were determined by measuring the reflection density of these samples. The results obtained are shown in Table 1 below.

TABLE 1

| Thermally-Developable Light-Sensitive Element | Fresh | | | After Forced Deterioration | | |
|---|---|---|---|---|---|---|
| | Fog | Dmax | Relative Sensitivity* | Fog | Dmax | Sensitivity* |
| A | 0.06 | 1.32 | 103 | 0.08 | 1.31 | 95 |
| B | 0.06 | 1.31 | 100 | 0.03 | 0.05 | — |

*relative value of the reciprocal of the exposure amount required to provide a density of 0.1 above fog, assuming that the sensitivity of fresh Thermally Developable Light-Sensitive Element (B) is 100

As is apparent from the results in Table 1 above, the subbing layer comprising a copolymer of vinyl chloride and vinyl acetate markedly prevents a reduction in Dmax due to the forced deterioration test under high humidity conditions. The element in accordance with the present invention also exhibited acceptable fog and sensitivity.

COMPARATIVE EXAMPLE 1

Two types of Thermally Developable Light-Sensitive Elements (C) and (D) were preparted using exactly the same procedures as those for Thermally Developable Light-Sensitive Elements (A) and (B) as described in Example 1, except for adding N-bromosuccinimide over a period of 10 seconds in place of 90 minutes. The average grain size of silver bromide grains produced during this procedure measure in the same manner as about 0.03$\mu$.

Exactly the same testing as in Example 1 was also conducted with respect to these Thermally Developable Light-Sensitive Elements (C) and (D). The results obtained are shown in Table 2 below.

TABLE 2

| Thermally Developable Light-Sensitive Element | Presence or Absence of Subbing Layer of Invention | Average Gain Size of silver Halide ($\mu$) | Fresh | | | After Forced Deterioration | | |
|---|---|---|---|---|---|---|---|---|
| | | | Fog | Dmax | Relative Sensitivity* | Fog | Dmax | Relative Sensitivity* |
| (C) | Present | 0.03 | 0.06 | 1.38 | 35 | 0.07 | 1.39 | 30 |
| (D) | Absent | 0.03 | 0.06 | 1.30 | 36 | 0.05 | 1.15 | 20 |
| (B) | Absent | 0.06 | 0.06 | 1.31 | 100 | 0.03 | 0.05 | — |

*relative value, assuming that the sensitivity of fresh Thermally Developable Light-Sensitive Element (B) was 100

As is apparent from the results in Table 2 above, the reduction in Dmax due to the forced deterioration testing at high humidity conditions was very small even in the absence of the subbing layer of the present invention, when the average grain size of the silver bromide grains was fine. The element in accordance with the present invention also exhibited acceptable fog and sensitivity.

COMPARATIVE EXAMPLE 2

The same preparation procedures and testing as described in Example 1 was conducted using Thermally Developable Light-Sensitive Element (E) prepared in the same manner as described for Thermally Developable Light-Sensitive Element (A), except for coating a layer comprising the copolymer of vinyl chloride and vinyl acetate on the back of the paper support (i.e., on the opposite side to the surface of the support having thereon the light-sensitive layer). The results obtained are shown in Table 3 below

TABLE 3

| Thermally Developable Light-Sensitive Element | Copolymer Layer | Fresh | | | After Forced Deterioration | | |
|---|---|---|---|---|---|---|---|
| | | Fog | Dmax | Relative Sensitivity* | Fog | Dmax | Relative Sensitivity* |
| E | Back of Layer | 0.10 | 1.31 | 89 | 0.10 | 0.20 | — |
| B | None | 0.06 | 1.31 | 100 | 0.03 | 0.05 | — |

*relative value, assuming that the sensitivity of fresh Thermally Developable Light-Sensitive Element (B) was 100

As is apparent from the results in Table 3 above, the reduction in Dmax due to the forced deterioration testing under high humidity conditions can not be prevented even by coating a layer comprising a copolymer of vinyl chloride and vinyl acetate on the back of the paper support. As a result, it was found that the layer comprising a copolymer of vinyl chloride and vinyl acetate must be positioned between the thermally developable light-sensitive layer and the paper support.

EXAMPLE 2

Exactly the same preparation procedures and testing as that in Example 1were conducted using the Thermally Developable Light-Sensitive Elements (A) and (B) employed in Example 1, except for using, as the paper support, a baryta paper in place of the paper support wherein the base paper for a pressure-sensitive copying paper had been sized with polyvinyl alcohol to produce Thermally Developable Light-Sensitive Elements (F) and (G) respectively. The results obtained are shown in Table 4 below.

TABLE 4

| Thermally Developable Light-Sensitive Element | Subbing Layer of Invention | Fresh | | | After Forced Deterioration | | |
|---|---|---|---|---|---|---|---|
| | | Fog | Dmax | Relative Sensitivity* | Fog | Dmax | Relative Sensitivity* |
| (F) | Present | 0.05 | 1.41 | 105 | 0.06 | 1.40 | 98 |
| (G) | Absent | 0.05 | 1.42 | 103 | 0.03 | 0.11 | — |

*relative value, assuming that the sensitivity of fresh Thermally Developable Light-Sensitive Element (B) was 100

As is apparent from the results in Table 4 above, the subbing layer comprising a copolymer of vinyl chloride and vinyl and acetate which is used in the present invention prevents quite well the reduction in Dmax due to the forced deterioration testing. The element in accordance with the present invention also exhibited acceptable fog and sensitivity.

EXAMPLE 3

The same preparation procedures and testing as in Example 1 was exactly repeated using the thermally developable light-sensitive element employed therein, except for using atetrahydrofuran solution containing 5 percent by weight of Saran F220 (tradename for a copolymer of vinylidene chloride and vinyl chloride, manufactured by Dow Chemical Co., Ltd.; believed to have an average monomer molar ratio of vinylidene chloride to vinyl chloride; 80–90:10–20) in place of the copolymer of vinyl chloride and vinyl acetate, Thermally Developable Light-Sensitive Element (A). The results obtained are shown in Table 5 below.

TABLE 5

| Thermally Developable Light-Sensitive Element | Subbing Layer of Invention | Fresh | | | After Forced Deterioration | | |
|---|---|---|---|---|---|---|---|
| | | Fog | Dmax | Relative Sensitivity* | Fog | Dmax | Relative Sensitivity* |
| (H) | Present | 0.06 | 1.30 | 100 | 0.08 | 1.30 | 90 |
| (B) | Absent | 0.06 | 1.31 | 100 | 0.03 | 0.05 | — |

*relative value, assuming that the sensitivity of fresh Thermally Developable Light-Sensitive Element (B) was 100

As is apparent from the results described in Table 5 above, the subbing layer comprising the copolymer of vinylidene chloride and vinyl chloride which is used in the present invention gives rise to superior effects providing an excellent retention of Dmax with high sensitivity and an acceptable degree of fog.

COMPARATIVE EXAMPLE 3

Two types of Thermally Developable Light-Sensitive Elements (I) and (J) were each prepared exactly according to the method for producing Thermally Developable Light-Sensitive Element (A) in Example 1, except for using an acetone solution containing three percent by weight of cellulose diacetate (L-30B, L-AC; manufactured by Daisel Co., Ltd.; average polymerization degree: 150) and an acetone solution containing three percent by weight of polyvinyl butyral [DENKA BUTYRAL (#300-K), manufactured by Denki Kagaku Co., Ltd.; average polymerization degree: 700], respectively in place of the copolymer of vinyl chloride and vinyl acetate.

The same testing as in Example 1 was exactly repeated and the results obtained thereby are shown in Table 6 below.

TABLE 6

| Thermally Developable Light-Sensitive Element | Polymer for Subbing Layer | Fresh | | | After Forced Deterioration | | |
|---|---|---|---|---|---|---|---|
| | | Fog | Dmax | Relative Sensitivity* | Fog | Dmax | Relative Sensitivity* |
| (I) | Cellulose Diacetate | 0.06 | 1.26 | 65 | 0.03 | 0.03 | — |
| (J) | Polyvinyl Butyral | 0.12 | 1.30 | 85 | 0.03 | 0.03 | — |
| (B) | Absent | 0.06 | 1.31 | 100 | 0.03 | 0.05 | — |

*relative value, assuming that the sensitivity of fresh Thermally Developable Light-Sensitive Element (B) was 100

As is apparent from the results in Table 6 above, a subbing layer comprising cellulose diacetate or polyvinyl butyral does not prevent the reduction in Dmax due to the forced deterioration and in addition, rather reduces the sensitivity of the fresh photographic element.

EXAMPLE 4

A thermally developable light-sensitive element was prepared in the same manner as described for the preparation of Thermally Developable Light-Sensitive Element (A) of Example 1. On a thermally developable light-sensitive layer of the thus prepared thermally developable light-sensitive element was provided a protective uppermost polymer layer by coating a 2.5% by weight solution of cellulose diacetate in a mixture of acetone and ethanol (9:1 by weight) in an amount of 1 g/m$^2$. Thus Thermally Developable Light-Sensitive Element (K) was prepared.

Further, the same procedures as set forth above were repeated to prepare Thermally Developably Light-Sensitive Element (L) with the exception that as a polymer component for the subbing layer a vinyl chloride-vinyl acetate-maleic acid terpolymer (MPR-TM produced by Nisshin Kagaku Co.; average monomer molar ratio of vinyl chloride, vinyl acetate and maleic acid; 86:13:1: average polymerization degree; 420) was used.

These two types of Thermally Developable Light-Sensitive Elements (K) and (L) thus prepared were each exposed and heat-developed in the same manner as described in Example 1. Black spots were observed in the intermediate density (optical density of 0.4–0.7) area of Thermally Developable Light-Sensitive Element (K), whereas no such spots were observed in Thermally Developable Light-Sensitive Element (L). Other photographic properties were measured and the results obtained are shown in Table 7 below.

TABLE 7

| Thermally Developable Light-Sensitive Element | Fresh | | | After Forced Deterioration | | |
|---|---|---|---|---|---|---|
| | Fog | Dmax | Relative Sensitivity* | Fog | Dmax | Relative Sensitivity* |
| (K) | 0.06 | 1.31 | 100 | 0.07 | 1.31 | 88 |
| (L) | 0.06 | 1.31 | 96 | 0.06 | 1.32 | 90 |

*relative value, assuming that the sensitivity of fresh Thermally Developable Light-Sensitive Element (K) was 100

These elements in accordance with the present invention showed excellent Dmax retention and high sensitivity in combination with a fog level which was not increased to any meaningful degree.

EXAMPLE 5

A coating solution for the thermally developable light-sensitive layer prepared in the same manner as described in Example 1 was coated in an amount of 0.4 g/m$^2$ of silver on a paper support as described in Example 1 having therein the various subbing layers shown in Table 8 below and was dried at 70° C. for 10 min. On each thermally developable light-sensitive layer thus provided a 2.5% by weight solution of cellulose diacetate in a mixture of acetone and ethanol (9:1 by weight) was coated in dry thickness of about 1μ to provide a protective uppermost polymer layer, followed by drying at 50° C. for 10 min. and thus Thermally Developable Light-Sensitive Elements (M) to (R) were prepared.

TABLE 8

| Thermally Developable Light-Sensitive Element | Composition of Subbing Layer |
|---|---|
| | (Coated Amount (g) per m$^2$ of the Support indicated in "[]") |
| (M) | No Subbing Layer |
| (N) | Vinyl Chloride-Vinyl Acetate Copolymer* having [3 g] |
| (O) | Copolymer of (N) set forth above [3 g] and Stearyl Alcohol [0.3 g] |
| (P) | Copolymer of (N) set forth above [3 g] and Stearyl Alcohol [0.1 g] |
| (Q) | Copolymer of (N) set forth above [3 g] and Eicosanol [0.3 g] |
| (R) | Copolymer of (N) set forth above [3 g] and Eicosanol [0.1 g] |

*Vinyl Chloride-Vinyl Acetate Copolymer same as used in Example 1.

Each sample thus obtained was cut in two pieces. One piece was exposed to light from a tungsten lamp through an optical step wedge in an exposure amount of 30,000 lux.sec. which provided sufficient Dmax, then was heat-developed at 130° C. for 8 sec. In order to evaluate the storage stability of the fresh photographic element, the other piece was stored for 1 week at 35° C. and 80% RH and thereafter exposed and heat-developed in the same manner as the sample piece which was not stored. The results obtained are shown in Table 9 below.

TABLE 9

| Thermally Developable Light-Sensitive Element | Dmax | Dmin (i.e., fog) | $S_{0.6}$* | Spots** |
|---|---|---|---|---|
| (M) | 1.30 | 0.12 | 100 | Almost None |
| | (0.20) | (0.05) | (1) | " |
| (N) | 1.28 | 0.12 | 90 | Many |
| | (1.05) | (0.08) | (70) | " |
| (O) | 1.28 | 0.12 | 95 | Almost None |
| | (1.10) | (0.08) | (80) | " |

TABLE 9-continued

| Thermally Developable Light-Sensitive Element | Dmax | Dmin (i.e., fog) | $S_{0.6}$* | Spots** |
|---|---|---|---|---|
| (P) | 1.28 | 0.12 | 90 | Some |
| | (1.06) | (0.08) | (70) | " |
| (Q) | 1.28 | 0.12 | 95 | Almost None |
| | (1.12) | (0.08) | (80) | " |
| (R) | 1.28 | 0.12 | 90 | " |
| | (1.07) | (0.08) | (75) | " |

Value in "( )" is of the sample stored at 35° C., 80% RH for 1 week.
*$S_{0.6}$ is a relative value of the reciprocal of the exposure amount required to provide a density of 0.6 above Dmin, assuming that the sensitivity of fresh Thermally Developable Light-Sensitive Element (M) is 100.
**Spots occurred at non-exposed areas or exposed areas with each of exposure after development.

EXAMPLE 6

A coating solution for a thermally developable light-sensitive layer prepared in the same manner as described in Example 1 was coated in an amount of 0.3 g/m$^2$ of silver on a paper support as described in Example 1 having thereon the various subbing layers shown in Table 10 below, and was dried at 70° C. for 10 min. Thereafter, a protective uppermost polymer layer was provided on each thermally developable light-sensitive layer thus provided in the same manner as described in Example 5, thereby to prepare Thermally Developable Light-Sensitive Elements (S) to (U).

TABLE 10

| Thermally Developable Light-Sensitive Element | Composition of Subbing Layer |
|---|---|
| | (Amount (g) used per m$^2$ of Support indicated in "[]" |
| (S) | 170 ml of Methyl Ethyl Ketone solution containing 7.5 g of Vinyl Chloride-Vinyl Acetate Copolymer* and 1 g of Polyvinyl Butyral (average monomer molar ratio of vinyl butyral: vinyl alcohol: vinyl acetate = 85: 11: 4; average polymerization degree: about 700) [1.5 g] |
| (T) | 90 ml of Methyl Ethyl Ketone solution containing 7.5 g of Vinyl Chloride-Vinyl Acetate Copolymer* [1.5 g] |
| (U) | No Subbing Layer |

*Vinyl Chloride-Vinyl Acetate Copolymer same as used in Example 1.

These three types of Thermally Developable Light-Sensitive Elements (S), (T) and (U) were cut into two pieces, and one piece was exposed to light from a tungsten lamp (maximum exposure amount of 3000 CMS) and was developed by contacting the piece with a heated plate at 130° C. for 8 sec. The other piece was allowed to stand at 35° C. and 80% RH for 14 days for forced deterioration, thereafter exposed and heat-developed in the same manner as described above. The photographic properties were determined by measuring the reflection density and observing the image quality of these samples. The results obtained are shown in Table 11 below.

TABLE 11

| Thermally Developable Light-Sensitive Element | Fresh | | | After Forced Deterioration | | | Image Quality |
|---|---|---|---|---|---|---|---|
| | Fog | Dmax | Relative Sensitivity* | Fog | Dmax | Relative Sensitivity* | (Both Fresh and After Forced deterioration) |
| (S) | 0.06 | 1.31 | 100 | 0.07 | 1.30 | 90 | No spots |

TABLE 11-continued

| Thermally Developable Light-Sensitive Element | Fresh | | | After Forced Deterioration | | | Image Quality (Both Fresh and After Forced deterioration) |
|---|---|---|---|---|---|---|---|
| | Fog | Dmax | Relative Sensitivity* | Fog | Dmax | Relative Sensitivity* | |
| | | | | | | | occurred. Few bubbles were observed. |
| (T) | 0.06 | 1.32 | 103 | 0.08 | 1.31 | 95 | Many spots occurred. Many bubbles were observed. |
| (U) | 0.06 | 1.31 | 100 | 0.03 | 0.05 | | No spots occurred. Few bubbles were observed. |

*relative value of the reciprocal of the exposure amount required to provide a density of 0.1 above fog, assuming that the sensitivity of fresh Thermally Developable Light-Sensitive Element (U) is 100.

The elements in accordance with the present invention showed excellent Dmax retention and high sensitivity in combination with fog level which was not increased to any meaningful degree.

While the invention has been described in detail and with reference to specific embodiments thereof, it will be apparent to one skilled in the art that various changes and modifications can be made therein without departing from the spirit and scope thereof.

What is claimed is:

1. In a thermally developable light-sensitive element comprising a support having in one or more layers thereon at least (a) an organic silver salt, (b) light-sensitive silver halide grains and (c) a reducing agent, the improvement wherein the average grain size of the light-sensitive silver halide grain is 0.05$\mu$ or larger, the support is a gas-permeable support and the support has thereon a subbing layer comprising at least one copolymer selected from the group consisting of a vinyl chloride copolymer in which vinyl chloride is present in the copolymer in an amount of 50 mol % to 98% and a vinylidene chloride copolymer in which vinylidene chloride is present in the copolymer in an amount of 50 mol % to 98 mole %, whereby the light-sensitive element shows reduced thermal fog with the passage of time, said vinyl chloride type copolymer or the vinylidene chloride type copolymer is selected from the group consisting of a copolymer of a vinyl ester and vinyl chloride, a copolymer of an acrylate and vinyl chloride, a copolymer of a maleate and vinyl chloride, a copolymer of a fumarate and vinyl chloride, a copolymer of acrylonitrile and vinyl chloride, a copolymer of a vinyl alkyl ether and vinyl chloride, a copolymer of vinyl chloride and vinylidene chloride, a copolymer of acrylonitrile and vinylidene chloride, or a copolymer of a vinyl ester and vinylidene chloride.

2. The thermally developable light-sensitive element as claimed in claim 1, wherein the amount of the vinyl chloride or the vinylidene chloride to the other monomer(s) copolymerized therewith is in the range of 70 to 98 molar percent.

3. The thermally developable light-sensitive element as claimed in claim 1, wherein, the copolymer is a copolymer of vinylidene chloride and vinyl chloride and, the molar ratio of the vinylidene chloride to the vinyl chloride is in the range of 50:50 to 98:2.

4. The thermally developable light-sensitive element as claimed in claim 1, wherein the vinyl chloride type copolymer or the vinylidene chloride type copolymer has a polymerization degree of about 30 or greater.

5. The thermally developable light-sensitive element as claimed in claim 4, wherein the vinyl chloride type copolymer or the vinylidene chloride type copolymer has a polymerization degree of from 50 to 50,000.

6. The thermally developable light-sensitive element as claimed in claim 2, wherein the copolymer is a copolymer of vinyl acetate and vinyl chloride or a copolymer of vinyl chloride and vinylidene chloride.

7. The thermally developable light-sensitive element as claimed in claim 1, wherein the amount of the copolymer present ranges from about 0.1 g to about 10 g per square meter of the support.

8. The thermally developable light-sensitive element as claimed in claim 7, wherein the amount of the copolymer present ranges from 0.2 g to 3 g per square meter of the support.

9. The thermally developable light-sensitive element as claimed in claim 1, wherein the gas-permeable support is a paper support, a cloth support, an unglazed ceramic support or a porous synthetic high molecular weight sheet support.

10. The thermally developable light-sensitive element as claimed in claim 1, wherein said element includes an protective polymer layer as an uppermost layer.

11. The thermally developable light-sensitive element as claimed in claim 1, wherein said element comprises said gas-permeable support having thereon, in order, said subbing layer comprising said at least one copolymer selected from the group consisting of said vinyl chloride copolymer and said vinylidene chloride copolymer and a thermally developable light-sensitive layer containing said component (a), said component (b) and said component (c).

12. The thermally developable light-sensitive element as claimed in claim 11, wherein said element additionally includes, as an uppermost layer, a protective polymer layer on said thermally developable light-sensitive layer.

13. The thermally developable light-sensitive element as claimed in claim 9, wherein said support is a paper support.

14. The thermally developable light-sensitive element as claimed in claim 1, wherein said subbing layer further includes a polyvinyl acetal in combination with said at least one copolymer, whereby the light-sensitive element shows reduced undesirable spots of higher optical density than the image obtained or bubbles after development.

15. The thermally developable light-sensitive element as claimed in claim 1, wherein said subbing layer further includes a higher alcohol in combination with said at least one copolymer, whereby the light-sensitive element shows reduced undesirable spots of higher optical density than the image obtained or bubbles after development.

16. The thermally developable light-sensitive element as claimed in claim 15, wherein said higher alcohol is present in an amount of about 0.01 to about 1 g/m$^2$ of said support.

17. The thermally developable light-sensitive element as claimed in claim 1, wherein said copolymer comprises maleic acid as a third comonomer.

18. The thermally developable light-sensitive element as claimed in claim 1, wherein said copolymer is a copolymer of vinyl diethyl phosphono acetate and vinyl chloride.

19. The thermally developable light-sensitive element as claimed in claim 1, wherein said copolymer is a copolymer of vinyl butylsulfonate and vinyl chloride.

20. The thermally developable light-sensitive element as claimed in claim 1, wherein said copolymer is a copolymer of 2,3-epoxypropyl methacrylate and vinyl chloride.

21. The thermally developable light-sensitive element as claimed in claim 1, wherein said copolymer is a copolymer of allyl 2,3-epoxypropyl ether and vinyl chloride.

22. The thermally developable light-sensitive element as claimed in claim 1, wherein said copolymer is a copolymer of ethyl or methyl acrylate and vinylidene chloride.

23. The thermally developable light-sensitive element as claimed in claim 14, wherein said polyvinyl acetal has a polymerization degree of about 200 to about 1500 and an acetalization degree of about 55 to about 90 weight % and is produced utilizing an aldehyde having 2 to 5 carbon atoms.

24. The thermally developable light-sensitive element as claimed in claim 1, wherein said subbing layer further includes a polyvinyl acetal and a higher alcohol in combination with said at least one copolymer, whereby the light-sensitive element shows reduced undesirable spots of higher optical density than the image obtained or bubbles after development.

25. The thermally developable light-sensitive element as claimed in claim 24, wherein said polyvinyl acetal has a polymerization degree of about 200 to about 1500 and an acetalization degree of about 55 to about 90 weight %, and is produced utilizing an aldehyde having 2 to 5 carbon atoms and is utilized in an amount of about 1 to 100 parts by weight based on 100 parts by weight of said copolymer in said subbing layer, wherein said higher alcohol has a melting point above about 40° C. and is present in an amount of about 0.01 to about 1 g/m$^2$ of said support.

26. The thermally developable light-sensitive element as claimed in claim 1, wherein the average grain size of the light-sensitive silver halide grain is 0.05$\mu$ to 5$\mu$.

27. The thermally developable light-sensitive element as claimed in claim 1, wherein the copolymer is a vinyl chloride type copolymer and is a copolymer of a vinyl ester and vinyl chloride.

28. The thermally developable light-sensitive element as claimed in claim 27, wherein the acid of said ester is a carboxylic acid and has from 1 to 22 carbon atoms.

29. The thermally developable light-sensitive element as claimed in claim 1, wherein said ester is vinyl acetate.

30. The thermally developable light-sensitive element as claimed in claim 14, wherein said polyvinyl acetal is utilized in an amount of about 1 to 100 parts by weight based on 100 parts by weight of said copolymer in said subbing layer.

31. The thermally developable light-sensitive element as claimed in claim 24, wherein said higher alcohol has a melting point above about 40° C.

* * * * *